US005704085A

United States Patent [19]

Sabalaskey

[11] Patent Number: 5,704,085

[45] Date of Patent: Jan. 6, 1998

[54] EDGE SUPPORT FOR A MATTRESS

[75] Inventor: Robert J. Sabalaskey, Carol Stream, Ill.

[73] Assignee: Serta, Inc., Itasca, Ill.

[21] Appl. No.: 687,798

[22] Filed: Jul. 19, 1996

[51] Int. Cl.[6] ..... A47C 27/00

[52] U.S. Cl. ..... 5/717; 5/721; 5/739

[58] Field of Search ..... 5/717, 721, 739, 5/716, 727, 740

[56] References Cited

U.S. PATENT DOCUMENTS

| | | | |
|---|---|---|---|
| 1,371,362 | 3/1921 | Giese . | |
| 1,915,659 | 6/1933 | Gail | 5/717 |
| 2,069,415 | 2/1937 | Lotz | 5/717 |
| 2,319,431 | 5/1943 | Owen | 5/717 |
| 2,399,628 | 5/1946 | Cunningham | 5/740 |
| 3,521,311 | 7/1970 | Cohen | 5/740 |
| 4,213,214 | 7/1980 | Gilhooly . | |
| 4,286,344 | 9/1981 | Ikeda | 5/717 |
| 4,389,743 | 6/1983 | Callaway . | |
| 4,679,266 | 7/1987 | Kraft . | |
| 5,107,558 | 4/1992 | Luck . | |
| 5,113,539 | 5/1992 | Strell . | |
| 5,579,549 | 12/1996 | Selman | 5/721 |

FOREIGN PATENT DOCUMENTS

| | | |
|---|---|---|
| 0011755 | 6/1980 | European Pat. Off. . |
| 639546-A5 | 11/1983 | Switzerland . |

OTHER PUBLICATIONS

Copyright 1994 Capital Cities Media Inc.; HFD–The Weekly Home Furnishings Newspaper; Oct. 17, 1994; pp. 20–25.

Copyright 1995 Capital Cities Media Inc.; HFN—The Weekly Newspaper for the Home Furnishing Network; Apr. 24, 1995; pp. 8–13.

Mattress Sets (Home & Garden Buying Guide); Praeger, Anne; Consumers Digest, v33, n2, p.48 (3); Mar.–Apr., 1994.

*Primary Examiner*—Flemming Saether

*Attorney, Agent, or Firm*—Gardner, Carton & Douglas

[57] ABSTRACT

A mattress including an innerspring, upholstery topper layers including at least one foam layer, and quilt panel layers. At least one upholstery foam layer includes a firming edge of foam about its perimeter. The firming edge of the upholstery foam layer functions to provide a firmer mattress edge without compromising the thickness of the mattress or requiring additional materials or labor operations during manufacturing.

17 Claims, 1 Drawing Sheet

EDGE SUPPORT FOR A MATTRESS

FIELD OF THE INVENTION

The invention relates to mattresses, and in particular, to the perimeter edge support of mattresses.

BACKGROUND OF THE INVENTION

A conventional mattress generally consists of an innerspring having at least one upholstery topper layer and at least one quilt layer about the top and bottom surfaces of the innerspring. The level of support and comfort provided by such a mattress, often referred to as "firmness," is a function of both the number and characteristics of the upholstery topper and the quilting panel layers about the top and bottom of the innerspring and of the performance characteristics of the innerspring.

The innerspring generally comprises border wires forming a rectangular structure and, within the structure, a plurality of interconnected coil springs. The coil springs are generally disposed in rows and columns over the entire area of the rectangular structure. When designing an innerspring, a number of variables which affect innerspring performance must be taken into consideration. Some of these variables include the coil count, the coil density, the coil shape, the number of turns of the coil, the gauge of the wire, the heat treatment of the wire, the technique used to assemble the innerspring, and the edge treatment.

In addition to the innerspring, a conventional mattress is provided with upholstery topper layers adjacent to the top and bottom surfaces of the innerspring. Each upholstery topper layer commonly includes an insulating layer of material in direct contact with the innerspring to mask or insulate from the sleeper the noise produced by the interaction between the components of the innerspring and also to prevent softer upholstery materials from falling or pocketing into the innerspring. This insulating layer of material can be constructed of, for example, wire mesh, plastic mesh, woven fabric, or non-woven fabric. Each upholstery topper layer further includes a layer of padding material which affects the firmness of the mattress. This layer of padding material is located directly adjacent to the insulating layer and can be constructed of natural fibers such as, for example, cotton, synthetic fibers, foam, or a fiber/foam combination. It should be understood that additional layers of padding can be provided for each upholstery topper layer, the number of padding layers depending upon the comfort level and quality of the mattress.

A quilt panel layer is provided adjacent to each upholstery layer. The quilt panel layers of the mattress provide the direct contact with the sleeper and thus the immediate perception of softness or "feel." Each quilt panel layer commonly includes a layer of mesh or cloth bottom or backing material, a layer of foam material positioned over the backing material, a layer of fiber or filler material positioned over the foam, and finally a layer of ticking forming the cover. The number of layers of foam and fiber in the quilt panel layer help to define the comfort level, quality, and expense of the mattress. The entire layer is stitched together with thread to form a quilt pattern. The quilt pattern holds the components of the layer together and provides a composite structure to the quilt panel layer.

A common problem with such conventional mattresses has been a lack of support about the perimeter edge. The edge support provided by a conventional mattress having a coil innerspring is usually inadequate due to the inherent physical characteristics of a coil. A coil is symmetric about its central axis and therefore must be inset to avoid extending beyond the edge of the innerspring. Thus, the edge of the innerspring, and consequently the edge of the mattress, do not provide adequate support. This lack of support is an inconvenience, since the perimeter edge of a mattress commonly functions to provide seating support for a sleeper. For example, when a sleeper sits on the edge of a mattress to get up from bed, the edge, instead of providing a firm support surface for the sleeper, sags. As can be appreciated, this makes it more difficult for the sleeper to get out of bed.

In order to address this problem, various attempts have been made to provide additional support to the innerspring of the mattress in hopes of providing a firmer edge for the mattress. One approach involves providing foam supports around individual springs located about the perimeter of the innerspring. Each support consists of a foam piece which is wrapped about the circumference of a spring located along the perimeter of the innerspring. Another approach involves providing a foam rail along each side of the mattress vertically in the innerspring between the first row of springs located along the perimeter and the second row of springs from the perimeter.

Yet another approach for solving this problem involves providing a biased wire support between the upper and lower border wires of the innerspring. The biased wire support structurally can take various forms. However, all such supports are positioned between the upper and lower border wires along the perimeter of the innerspring. Under the load of a sleeper sitting on the edge of a mattress, the supports act against the upper and lower border wires to keep them separated and provide a firming effect.

All these approaches, however, have the same disadvantage. After providing some form of additional support to the perimeter of the innerspring, upholstery topper layers and quilt panel layers are necessarily added to the innerspring to complete the manufacturing process of the mattress. Once these additional layers are added, any innerspring perimeter firming effect achieved is masked by the additional layers of upholstery and quilting. Consequently, any strength gained at the innerspring level of the mattress does not result in a firmer edge after the various upholstery layers are applied. For example, in the approach involving the biased wire supports positioned between the border wires, the use of these supports brings about an increase in firmness of the innerspring perimeter itself of approximately 30%. However, after the upholstery topper layers and quilt panel layers are put in place, the increase in firmness of the mattress perimeter edge is only 8–9%. Thus, despite these attempted solutions to firm up the perimeter of the innerspring, the perimeter side edges of the mattress remain soft.

One attempt to minimize the resulting disadvantage of these solutions is to provide thinner upholstery topper layers and quilt panel layers in order to allow a sleeper to feel the additional innerspring support. However, reducing the thickness of the upholstery and quilt layers results in a thinner mattress. Since consumers usually equate thinner mattresses with a cheaper, lower quality product, this approach would likely result in lost sales and revenues and thus, would not be desirable.

The above enhancements to the innerspring also bring about other disadvantages as well. Since the enhancements involve use of additional elements, such as foam supports or wire supports, this adds significantly to the cost of the mattress. Additionally, since the mattresses include additional elements, the assembly of the mattresses requires more time which, in turn, brings about an increase in the cost of labor. Thus, these enhancements not only fail to adequately solve the problem, but also bring about a substantial increase in the costs associated with manufacturing a mattress.

Thus, there is a need for a new and improved mattress which provides a firm edge about the perimeter of the mattress. The firm edge should be provided without compromising the thickness of the mattress. Further, providing such a firm edge should not require additional materials or labor operations during the manufacture of the mattress, thereby avoiding a significant increase in material and labor costs.

SUMMARY OF INVENTION

The present invention provides a new and improved mattress with a firm edge about the perimeter of the mattress. In providing a firm edge, the present invention does not compromise the thickness of the mattress and thus does not lead to negative consumer perceptions. Further, the present invention does not require additional materials or labor operations during manufacturing and thereby avoids a significant increase in material and labor costs.

The present invention achieves these advantages by providing a mattress having a means for providing a firm edge. The mattress includes an innerspring, upholstery topper layers, and quilt panel layers. Each upholstery topper layer includes a foam layer, with at least one of the foam layers of the upholstery layers being provided with the edge firming means. In the present invention, the edge firming means comprises an edge made of a material provided about the perimeter of the foam layer which is firm relative to the foam layer of the upholstery layer. In the preferred embodiment, the edge is made of a foam which is approximately 4 to 6 times firmer than the foam of the foam layer. This firming edge about the perimeter of the foam layer functions to provide a firm edge for the entire mattress.

The present invention addresses the problem of inadequate perimeter edge support of mattresses while avoiding reducing the padding in the mattress. Unlike the solutions of the past, there is no need in the present invention to reduce the number or thickness of upholstery topper layers and quilt panel layers in order for the sleeper to feel the additional support provided to the innerspring. Since the edge firming means is provided on the foam layer of the upholstery topper layer, which is a common component of a conventional mattress, the thickness of the mattress is not adversely affected.

In addition, the present invention does not increase the number of components used during the manufacture of a conventional mattress. Thus, as there is no need to stock additional materials to be used during the manufacturing process, a substantial increase in material costs is prevented. Further, since it involves no increase in the number of components used during manufacture, the present invention does not result in increased labor costs due to the manufacturing process.

DETAILED DESCRIPTION OF THE INVENTION

Figure 1:
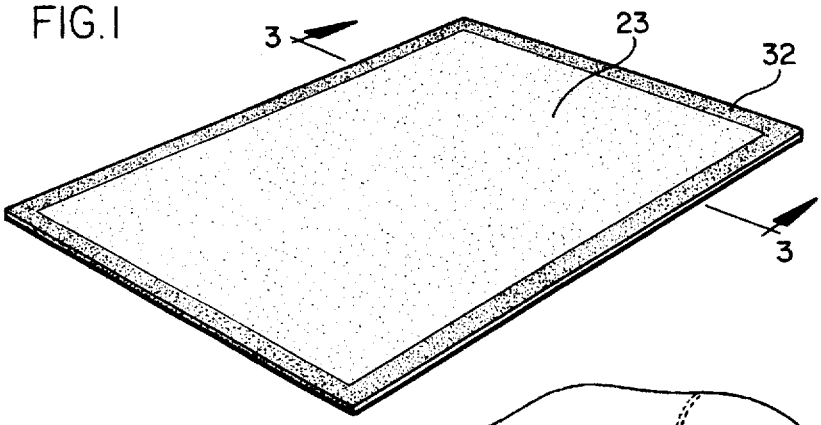
FIG. 1 is a top perspective view of a foam layer made in accordance with the principles of the present invention.
Figure 2:
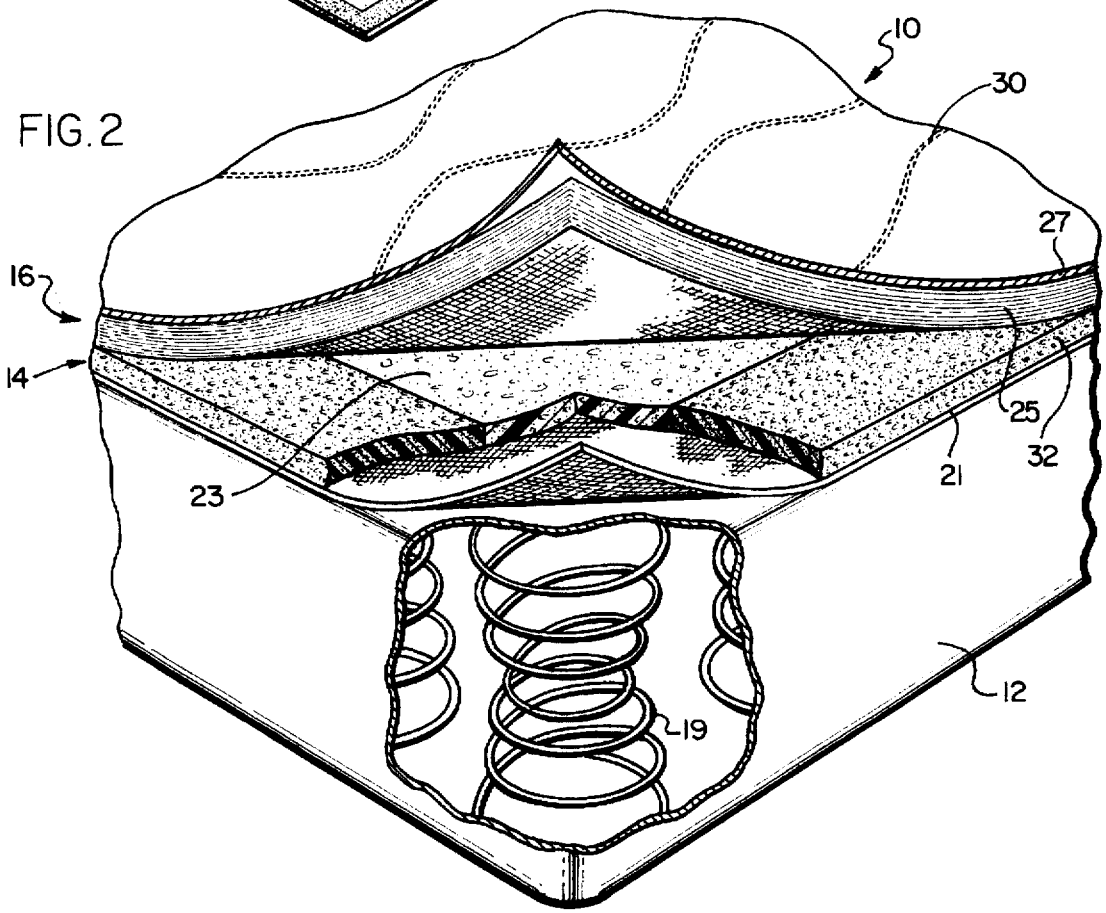
FIG. 2 is a perspective, cut-away view of a portion of a mattress made in accordance with the principles of the present invention.
Figure 3:
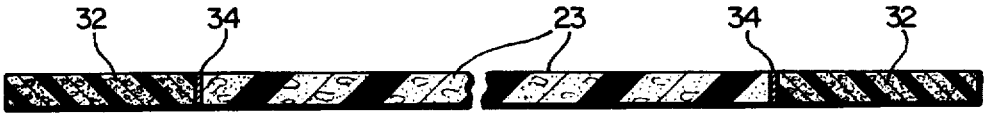
FIG. 3 is a cross section of the foam layer of FIG. 1 taken along line-3—3.

A mattress 10 made in accordance with the principles of the present invention is seen in FIGS. 1–3 and includes an innerspring 12, upholstery topper layers 14, and quilt panel layers 16. Although the upholstery topper layer 14 and the quilt layer 16 are shown in FIG. 2 only about the top surface of the mattress 10, it should be understood that the mattress 10 is generally provided with such upholstery topper and quilt layers about its bottom surface.

The innerspring 12 of the mattress 10 generally comprises border wires (not shown) forming a rectangular structure and, within the structure, a plurality of interconnected coil springs 19. The coil springs 19 are generally disposed in rows and columns over the entire area of the rectangular structure. The number of coils, their structure, and their arrangement depend upon the type of support to be provided and the size of the mattress.

The upholstery topper layers 14 are provided along the top and bottom surfaces of the innerspring 12. The quilt panels 16 are, in turn, provided along the top and bottom surfaces of the upholstery topper layers 14. Each upholstery topper layer 14 is constructed of a number of layers, including an insulator layer 21 constructed of, for example, wire mesh, plastic mesh, woven fabric, or non-woven fabric and at least one padding material layer 23 comprised of, for example, foam. Each of the quilt layers 16 is constructed of foam and/or fiber layers 25 with a covering of ticking 27. As can be seen in FIG. 2, the components of the quilt layer 16 are stitched together with thread 30 to form a quilt pattern.

In order to provide a firmer edge about the perimeter of the mattress 10, the present invention provides at least one foam layer 23 of an upholstery topper layer 14 with edge firming means for providing a firm edge about the perimeter of the mattress 10. The edge firming means comprises an edge 32 provided about the perimeter of the foam layer 23. The edge 32 is of a firmer material than the foam layer 23 and is to be constructed of a material that will provide a firming effect. Examples of such materials are polyurethane foam, rebond foam, fiber pad, and polystyrene foam. The foam used for the edge 32 is in the range of approximately 130 to 170 indentation force deflection (IFD), preferably approximately 150 IFD; in comparison, the foam used in remainder of the upholstery foam layer 23 varies from approximately 20–40 IFD, preferably approximately 30 IFD. Thus, the foam of the edge 32 is in the range of approximately 4 to 6 times firmer and preferably approximately 5 times firmer than the foam used in the foam layer 23. Although the figures depict the edge firming means to be provided to a foam layer made of flat foam, it is within the scope of this invention that such edge firming means can be provided to a foam layer constructed of convoluted foam.

As can be seen in FIG. 1, the firming edge 32, in a sense, frames the perimeter of the foam layer 23. The firming edge 32 can be attached to the perimeter of the foam layer by any suitable means, such as glue 34, as seen in FIG. 3. Other attaching means include heat bonding or adhesive solvents. In the preferred embodiment, the edge 32 is approximately 4 inches in width. Its length varies with the size of the mattress 10. Its thickness is preferably constant with the thickness of the foam layer. In the preferred embodiment, the thickness of the edge is approximately ⅝ inch.

When a sleeper sits on the edge of a mattress 10 made according to the principles of the present invention, the weight of the individual is supported by the quilt layers 16, the upholstery layers 14 with at least one firming edge 32, and the innerspring 12. The firming edge 32 functions to provide the mattress edge with additional support so as to provide a firm mattress edge for the sleeper.

It should be mentioned that the edge 32 functions to increase the height and strength characteristics of the innerspring 12 of the mattress 10 without reducing the mattress thickness or overall softness of the mattress in its center. When the load of a sleeper is applied to the periphery of the mattress, the foam edge collapses only slightly as compared to the remainder of the upholstery layer. Thus, the load of the sleeper is transmitted to and carried directly by the innerspring. However, when the sleeper is lying in the center of the mattress, the comfort level of the mattress is not adversely effected.

While the invention has been described in connection with certain embodiments, it should be understood that it is not intended to limit the invention to these particular embodiments. To the contrary, it is intended to cover all alternatives, modifications and equivalents falling within the spirit and scope of the invention as defined by the appended claims.

What is claimed is:

1. A mattress having a perimeter, comprising:

an innerspring;

at least one upholstery topper layer provided adjacent to the innerspring;

a foam layer provided in at least one of the upholstery topper layers;

at least one quilt panel layer provided adjacent to at least one of the upholstery topper layers; and an edge of foam attached about a perimeter of the foam layer providing an edge about the perimeter of the mattress which is firmer than the foam of the foam layer, wherein the edge of foam is attached directly to the perimeter of the foam layer.

2. The mattress of claim 1 wherein the edge is constructed of polyurethane foam.

3. The mattress of claim 1 wherein the foam of the edge has the same thickness as the foam of the foam layer.

4. The mattress of claim 1 wherein the edge is approximately from 4 to 6 times firmer than the foam of the foam layer.

5. The mattress of claim 4 wherein the edge is approximately 5 times firmer than the foam of the foam layer.

6. The mattress of claim 1 wherein the edge is attached to the perimeter of the foam layer with glue.

7. The mattress of claim 1 wherein the foam of the edge is in the range of approximately 130 to 170 IFD.

8. The mattress of claim 7 wherein the foam of the edge is approximately 150 IFD.

9. The mattress of claim 1 wherein the foam of the foam layer is in the range of approximately 20 to 40 IFD.

10. The mattress of claim 9 wherein the foam of the foam layer is approximately 30 IFD.

11. The mattress of claim 1 wherein the edge frames the perimeter of the foam layer.

12. A mattress having a perimeter, comprising:

an innerspring;

at least one upholstery topper layer provided adjacent to the innerspring;

a foam layer provided in at least one of the upholstery topper layers;

at least one quilt panel layer provided adjacent to at least one of the upholstery topper layers; and an edge of foam attached about a perimeter of the foam layer for providing an edge about the perimeter of the mattress which is firmer than the foam of the foam layer, wherein the foam of the edge is in the range of approximately 130 to 170 IFD.

13. The mattress of claim 12 wherein the foam of the edge is approximately 150 IFD.

14. The mattress of claim 12 wherein the foam of the foam layer is in the range of approximately 20 to 40 IFD.

15. The mattress of claim 14 wherein the foam of the foam layer is approximately 30 IFD.

16. The mattress of claim 12 wherein the edge is attached to the perimeter of the foam layer with glue.

17. The mattress of claim 12 wherein the edge is constructed of polyurethane foam.

* * * * *